US009567853B2

(12) United States Patent
Kulkarni et al.

(10) Patent No.: US 9,567,853 B2
(45) Date of Patent: Feb. 14, 2017

(54) WELLBORE OPERATIONS INVOLVING COMPUTATIONAL METHODS THAT PRODUCE SAG PROFILES

(71) Applicant: Halliburton Energy Services, Inc., Houston, TX (US)

(72) Inventors: Sandeep D. Kulkarni, Kingwood, TX (US); Dale E. Jamison, Humble, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/890,601

(22) PCT Filed: Oct. 17, 2013

(86) PCT No.: PCT/US2013/065340

§ 371 (c)(1),
(2) Date: Nov. 12, 2015

(87) PCT Pub. No.: WO2015/057222

PCT Pub. Date: Apr. 23, 2015

(65) Prior Publication Data

US 2016/0138395 A1 May 19, 2016

(51) Int. Cl.

| | |
|---|---|
| ***E21B 49/08*** | (2006.01) |
| ***E21B 44/00*** | (2006.01) |
| ***E21B 21/08*** | (2006.01) |

(52) U.S. Cl.

CPC ..... *E21B 49/08* (2013.01); *E21B 21/08* (2013.01); *E21B 44/00* (2013.01); *E21B 2049/085* (2013.01)

(58) Field of Classification Search

CPC ..... E21B 49/08; E21B 44/00; E21B 21/08; E21B 2049/085; G01N 9/00; G01N 15/04

See application file for complete search history.

(56) References Cited

U.S. PATENT DOCUMENTS

| | | | | |
|---|---|---|---|---|
| 6,176,323 | B1 * | 1/2001 | Weirich | E21B 21/08 175/40 |
| 6,584,833 | B1 | 7/2003 | Jamison et al. | |
| 7,243,735 | B2 | 7/2007 | Koederitz et al. | |
| 9,222,351 | B2 * | 12/2015 | Jamison | E21B 47/0905 |

(Continued)

OTHER PUBLICATIONS

Hansen et al., Investigation of Barite Sag in Weighted Drilling Fluids in Highly Deviated Wells, Society of Petroleum Engineers, SPE 20423, 1990.

(Continued)

*Primary Examiner* — Michael Wills, III

(74) *Attorney, Agent, or Firm* — McDermott Will & Emery LLP; Tenley Krueger

(57) ABSTRACT

Methods for analyzing sag in a section of a wellbore may utilize computational methods that produce sag profiles, which may be useful in performing further wellbore operations. The computational method may include inputs of at least one wellbore fluid property, at least one wellbore condition relating to a section of a wellbore, at least one operational parameter into a computational method, and any combination thereof. Further, the computational methods may include a mass balance analysis for individual elements of the meshed section of the wellbore.

17 Claims, 3 Drawing Sheets

(56) References Cited

U.S. PATENT DOCUMENTS

| | | | | |
|---|---|---|---|---|
| 2005/0126777 | A1 | 6/2005 | Rolovic et al. | |
| 2006/0162962 | A1 | 7/2006 | Koederitz et al. | |
| 2006/0190178 | A1 | 8/2006 | Zamora et al. | |
| 2011/0259598 | A1 | 10/2011 | Hilliard et al. | |
| 2013/0139583 | A1 | 6/2013 | Jamison et al. | |
| 2013/0332089 | A1* | 12/2013 | Kulkarni | G01N 15/04 702/50 |
| 2014/0202772 | A1* | 7/2014 | Kulkarni | E21B 21/08 175/65 |

OTHER PUBLICATIONS

Saasen, Arild, "Sag of Weight Materials in Oil Based Drilling Fluids," Society of Petroleum Engineers, IADC/SPE 77190, 2002.

Murphy et al., "Measuring and Predicting Dynamic Sag," SPE Drilling and Completions 103088, 2008.

Paslay et al., "A Phenomenological Approach to Analysis of Barite Sag in Drilling Muds," Society of Petroleum Engineers, SPE 110404, 2007.

Kulkarni et al., "Methods for Predicting Particulate Dynamic Sag Using Viscometer/Rheometer Data," U.S. Appl. No. 13/492,885, 2012.

Kulkarni et al., "Visco-Elastic Settling Rate Models to Determine Sag Potential of Non-Aqueous Drilling Fluids," American Association of Drilling Engineers, AADE-13-FTCE-26, 2013.

Kulkarni et al., "Drilling a Well with Predicting Sagged Fluid Composition and Mud Weight," U.S. Appl. No. 13/745,944, not dated.

Kulkarni et al., "Hindrance Effect on Barite Sag in Non-Aqueous Drilling Fluids," American Association of Drilling Engineers, AADE-12-FTCE-23, 2012.

Jefferson, D.T., "New Procedure Help Monitor Sag in the Field," paper ASME 91 PET 3, Energy Sources Technology Conference and Exhibition, New Orleans, Jan. 20-24, 1991.

International Search Report and Written Opinion for PCT/US2013/065340 dated Jul. 10, 2014.

Omland et al., Detection Techniques Determining Weighting Material Sag in Drilling Fluid and Relationship to Rheology, Annual Transactions of the Nordic Rheology Society, 2007, vol. 15.

* cited by examiner

WELLBORE OPERATIONS INVOLVING COMPUTATIONAL METHODS THAT PRODUCE SAG PROFILES

BACKGROUND

The exemplary embodiments described herein relate to methods for analyzing sag in a section of a wellbore via computational methods and performing wellbore operations based on a sag profile produced from the computational methods.

The wellbore fluids used in many wellbore operations include weighting agents (e.g., particles having a density greater than the base fluid including barite, ilmenite, calcium carbonate, marble, and the like) to increase the density of the wellbore fluid. The density of a wellbore fluid effects the hydrostatic pressure in the wellbore, which, when properly matched with the pore pressure of the formation, maintains the formation fluids. If the hydrostatic pressure in the wellbore is too low, the formation fluids may flow uncontrollably to the surface, possibly causing a blowout. If the hydrostatic pressure in the wellbore is too high, the subterranean formation may fracture, which can lead to fluid loss and possibly wellbore collapse.

As used herein, the term "sag" refers to an inhomogeneity or gradation in density of a fluid resulting from particles in the fluid settling (e.g., under the influence of gravity or secondary flow). Sag can be exacerbated with elevated temperatures.

Oftentimes in a wellbore operation, the circulation of the wellbore fluids through the drill string and wellbore is halted such that the wellbore fluid becomes substantially static in the wellbore (e.g., drill string tripping). In some instances, a low shear condition that allows for sag may be encountered when circulation is slowed, when the circulation may be halted and the drill string may be rotating, or a hybrid thereof. As used herein, the term "low shear" refers to a circulation rate of less than about 100 ft/min or a drill string rotation rate of less than 100 rpm. Static or low shear wellbore fluids may allow the weighting agents to settle (i.e., sag). Sag may not occur throughout an entire wellbore, but its occurrence in even a small section of the wellbore can cause well control issues like kicks, lost circulation, stuck pipes, wellbore collapse, and possibly a blowout. For example, if the density of the wellbore fluid, and consequently hydrostatic pressure, are higher than the fracture gradient of the formation, the formation may fracture and cause a lost circulation well control issue. In another example, sag may lead to a portion of the wellbore fluid having a sufficiently high density for a pipe to get stuck therein. Unsticking the pipe can, in some instances, cease the wellbore operation and require expensive and time consuming methods. In yet another example, large density variations in the wellbore fluid from sag can result in wellbore collapse. In another example, in some instances the lower density portion of the sagged fluid may readily flow when circulation is resumed or increased and leave the higher density portion of the fluid in place, which is time consuming and expensive to remove. Each of these well control issues and potential remediation are expensive and time consuming.

Sag in wellbore fluids is exacerbated by higher temperatures and deviation in the wellbore. Therefore, the recent strides in extended reach drilling, which have resulted in highly deviated wellbores at greater depths where temperatures can be greater, increase the concern for and possible instances of sag related problems in the oil and gas industry.

BRIEF DESCRIPTION OF THE DRAWINGS

The following figures are included to illustrate certain aspects of the embodiments, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

The exemplary embodiments described herein relate to methods for analyzing sag in a section of a wellbore via computational methods and performing wellbore operations based on a sag profile produced from the computational methods.

The computational methods and produced sag profiles described herein may be useful in mitigating the risk of well control issues. In some instances, the computational methods may be performed in-lab where the capabilities/limitations of wellbore fluids may be predicted and then used in developing a wellbore operation plan. In some instances, the computational methods may be performed in the field based on real-time data, where notifications or automated processes may trigger an action that mitigates the risk of well control issues. Proactively mitigating well control risks may advantageously reduce the incidence of well control issues, which should be safer for workers, reduce the environmental issues associated with well control issues like blowouts), and reduce the non-productive time and cost associated with well control issues.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by the embodiments of the present invention. At the very least, and not as an attempt to limit the application of the doctrine of equivalents to the scope of the claim, each numerical parameter should at least be construed in light of the number of reported significant digits and by applying ordinary rounding techniques according to the description herein.

Some embodiments described herein may involve performing a computational method configured to analyze sag within a section of a wellbore and then performing a wellbore operation based on the results (or outputs) from the computational method. As used herein, the term "computational method," unless otherwise specified, refers to a computational method configured to analyze sag within a section of a wellbore.

Figure 1B:
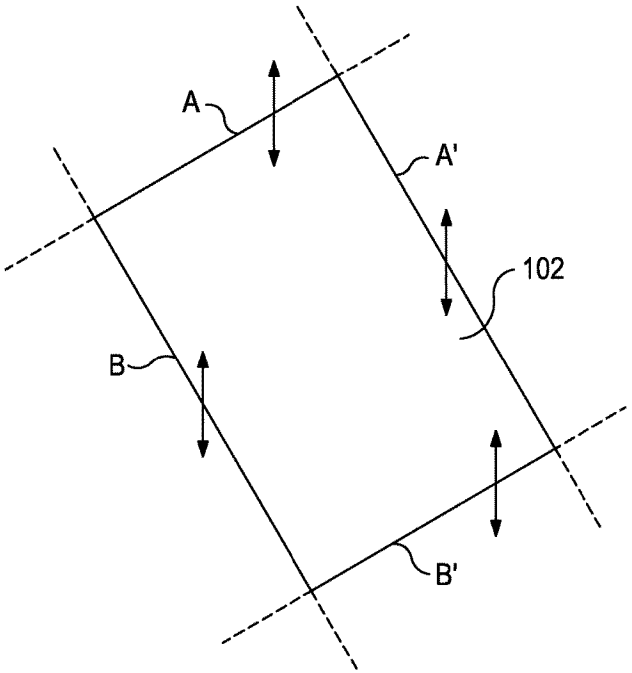
FIG. 1B provides a representation of the mass-balance as applied to an individual element of the meshed wellbore in FIG. 1A.
Figure 1A:
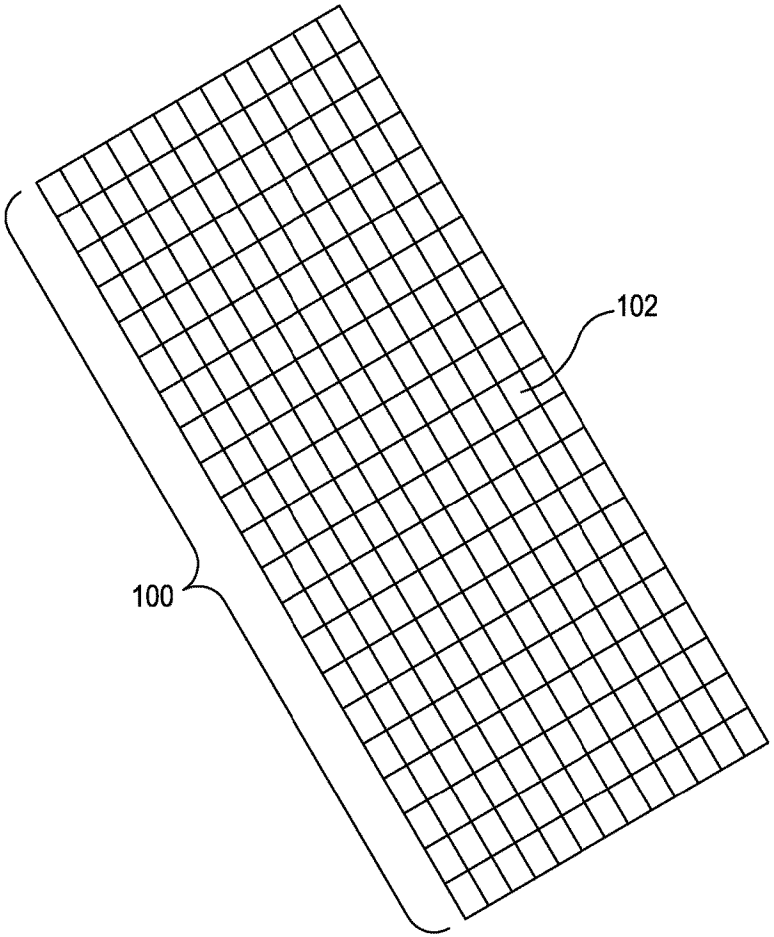
FIG. 1A provides a 2-D example of a wellbore section meshed into elements.

The computational methods suitable for use in the methods described herein are based on meshing (in 2-D or 3-D) a section of a wellbore into elements and performing a mass-balance analysis between the elements to calculate the changes in density or sag within the wellbore fluid. FIG. 1A provides a 2-D example of a wellbore section 100 meshed into elements 102. FIG. 1B provides a representation of the mass-balance analysis as applied to an individual element 102 that accounts for the mass influx and mass out across element boundaries A,A',B,B' of individual components of the wellbore fluid (e.g., weighting material, additives (like polymers), and the base fluid and components thereof like the emulsion or discontinuous phase) and the net mass influx and mass out (addition or depletion) is termed as the mass accumulation of the corresponding components within the individual elements. Note that some element boundaries A,A',B,B' may not allow for mass influx or mass out (e.g., an element 102 at a section boundary or when a neighboring element has no additional capacity). Formulas 1-3 provides examples of equations suitable for use in a mass balance analysis of individual elements within the meshed section of the wellbore, where i is a component, t is time, m is mass, $m^{in}$ is mass influx, $m^{in}$ is mass influx, $m^{out}$ is mass out, $m^{acc}$ is mass accumulated, and MW is mud weight (or density).

$$[m_{i,t}^{in}-m_{i,t}^{out}]^{A,A',B,B'}=m_{i,t}^{acc} \quad \text{Formula 1}$$

$$m_{i,t}=m_{i,t-1}+m_{i,t}^{acc} \quad \text{Formula 2}$$

$$[MW_t]=\Sigma_i[m_{i,t}] \quad \text{Formula 3}$$

The mass-balance analysis, specifically $m^{in}$ and $m^{out}$, may take into account wellbore conditions (e.g., temperature and pressure), wellbore fluid properties (e.g., viscosity and composition), and operational parameters (e.g., lapse time at static or low shear conditions and fluid flow rate). In some instances, these inputs may be measured real-time (e.g., in-the-field). In some instances, these inputs may be historical data from other wellbore operations (e.g., drilling operations for wellbore in the same field). In some instances, these inputs may be hypothetical estimations or from a matrix of inputs (e.g., when performing in-lab analysis of the capabilities/limitations of a wellbore fluid or when developing a wellbore operation plan). In some instances, combinations of the foregoing may be suitable.

The elements of the computational methods may be sized as needed to account for accuracy, which is enhanced by more, smaller elements, and speed or computing power, which is reduced by fewer, larger elements. For example, in-lab methods may have smaller elements, while in-field methods may have larger elements where computing power may be limited.

The density of individual elements may be combined into a sag profile of a section of a wellbore. In some instances, the sag profile may be represented by a gradient. In some instances, a depleted zone and a sagged zone of the sag profile may be identified. As used herein, the term "depleted zone" refers to the portion of the section of the wellbore with a density that has decreased by a predetermined amount (e.g., about 0.1 pounds per gallon ("ppg")). As used herein, the term "sagged zone" refers to the portion of the section of the wellbore with a density that has increased by a predetermined amount (e.g., about 0.1 ppg). The predetermined amount of density change used to define the depleted and sagged zones may vary based on the type of wellbore operation, the difference or desired difference between the ECD and the fracture gradient, and the like. For example, formations that include lithologies with a higher strength may be able to allow for a larger change in density before a well control issue arises (e.g., before a fracture gradient is exceeded, which may lead to lost circulation). It should be noted that within a sagged zone or a depleted zone, the density may vary, including a gradient variation or layered variation in density across or within the sagged zone or the depleted zone.

In some instances, the volume percent of the depleted and sagged zones relative to the volume of the section of the wellbore (in combination with the values that define the depleted and sagged zones) may indicate the risk of a well control issue, and in some instances, if an action should be taken to mitigate that risk. In some instances, the actions may be input in the computational method to analyze if the risk of the well control issue has been mitigated.

Actions that may be taken to mitigate the risk of a fracturing the formation may include, but are not limited to, resuming fluid flow for a time sufficient to reduce volume percent of the depleted and sagged zones by a desired amount, modifying the wellbore fluid properties, modifying the flow rates (e.g., in low shear settling situation), modifying the drill pipe rotation rate (including from no rotation to some rotation), and the like, and any combination thereof.

In some instances, the sag profile may be used to determine a transient wellbore condition, which may be used to determine appropriate operational parameters to use when fluid flow is resumed or changed to mitigate the occurrence of a well control issue. As used herein, the term "transient wellbore condition" refers to a temporary wellbore condition, which may be a result of sag in the wellbore fluid. For example, the sag profile may be used to determine a transient equivalent circulating density for the wellbore section, which may affect the pump flow rate suitable for use when resuming fluid flow or changing fluid flow rate so as to mitigate the occurrence of a wellbore control issue.

Some embodiments may involve inputting at least one wellbore fluid property, at least one wellbore condition relating to a section of a wellbore, and at least one operational parameter into a computational method, wherein the wellbore fluid property relates to a wellbore fluid that comprises a weighting agent; producing a sag profile of the section of the wellbore; and performing a wellbore operation with at least one of a second operational parameter and a second wellbore fluid property based on the sag profile. It should be noted that as used herein "a weighting agent" does not imply a single composition (e.g., only barite particles), but also encompasses multiple compositions that may vary by chemical composition, size, shape, coating or surface modification, and the like (e.g., a mixture of barite and ilmenite particles, a mixture of 10 micron average diameter barite and 35 micron average diameter barite, and the like).

Examples of wellbore fluid property inputs may include, but are not limited to, the wellbore fluid composition, a solids settling rate, a sagged fluid composition, an associative stability between a weighting agent particle and an emulsified phase in the wellbore fluid, a concentration of weighting agent particles, a rheological property, a fluid density, an oil-to-water ratio, a gel property, a water-phase salinity, a static aging profile, fluid compressibility, temperature and/or pressure effects on the foregoing properties, and the like, and any combination thereof.

In some instances, these fluid properties may be measured directly, calculated, measured by a secondary method, or the like. For example, a series of thermocouples may be placed along the drill string or the like to measure the temperature along the wellbore. In another example, a solids settling rate in a wellbore fluid may be quantitatively determined using data gathered from viscometer and/or rheometer, which may be performed in-lab or at the well site. The solids settling rate for dynamic or static sag may also be determined using specialized sag test devices (e.g., an apparatus that comprises a tube and shear shaft assembly that allows for a controlled rate of shear to be applied to a sample of the fluid for testing). In another example, the associative stability reflects the ability of the emulsion to resist sag (i.e., the propensity of the aqueous phase and the particulates fraction to remain associated) and can be measured by evaluating if solids that settle from the wellbore fluid are accompanied by emulsion vesicles during static aging tests. In yet another example, the sagged fluid composition may, in some instances, be measured by static aging tests. While in some instances, the sagged fluid composition may be calculated assuming that the maximum packing of the dispersed phase in the settled fluid is between 0.60-0.70 and that the solids associate with the emulsion phase, where the associative stability described above may be used to improve such a calculation.

Examples of wellbore condition inputs may include, but are not limited to, a temperature in the wellbore, a pressure of the wellbore, a diameter of the wellbore, a length of the section of the wellbore, a deviation angle of the section of the wellbore, drill string eccentricity, the depth of the wellbore (e.g., as measured from the head along the wellbore or vertically from the surface to the wellbore) and the like, and any combination thereof.

Examples of operational parameter inputs may include, but are not limited to, a lapse time at static or low shear conditions, a flow rate of the wellbore fluid (which can infer shear rate), a drill string geometry, a drill string rotation speed, a tripping speed, a connection time, and the like, and any combination thereof.

In some instances, the steps of inputting inputs (i.e., the wellbore fluid properties, the wellbore conditions, and the operational parameters) into the computational method and producing a sag profile may be in-lab where the section of the wellbore is not explicitly based on an existing wellbore. As such, these steps may be repeated many times for various values of the inputs. These methods may provide information as to how to perform the wellbore operation in-the-field, and therefore, at least one of a second operational parameter, a second wellbore fluid property, and a second wellbore condition that is implemented or suggested for implementation in-the-field is based on the sag profile from the computational method. In some instances, at least one of the second operational parameter, the second wellbore fluid property, and the second wellbore condition may have values that were analyzed by the computational method. In some instances, the second operational parameter and/or the second wellbore fluid property may have values that are similar to the values analyzed by the computational method. Changing of the values from those analyzed to those implemented may be based on the availability of materials, the capabilities of the equipment at the well site, and the like.

Some in-field embodiments may involve measuring (e.g., real-time, periodically, or the like) at least some of the inputs for the computational method. Measuring the inputs may involve the use of sensors downhole, at the wellhead, or coupled to associated equipment.

In some instances, the sag profile may include a volume percent corresponding to a sagged zone, a volume percent corresponding to a depleted zone, or both. In some instances, the computational method may be configured to notify an operator when the volume percent of these zones is outside a predetermined range (e.g., a range with acceptable levels of risk for a well control issue). In some instances, the computational method may be configured to automatically take an action to mitigate a well control issue when the volume percent of these zones is outside a predetermined range.

Examples of applications of the computational methods described herein may include, but are not limited to, drilling operations (e.g., drilling a wellbore penetrating subterranean formation, completion operations, and fracturing operations), analyzing pressure variations in fluids trapped behind the casing, and the like.

In some embodiments, the computational methods and associated steps (e.g., measuring real-time data) may be operated under computer control, remotely and/or at the well site. In some embodiments, the computer and associated algorithm for each of the foregoing can produce an output that is readable by an operator who can manually change the operational parameters.

It is recognized that the various embodiments herein directed to computer control and artificial neural networks, including various blocks, modules, elements, components, methods, and algorithms, can be implemented using computer hardware, software, combinations thereof, and the like. To illustrate this interchangeability of hardware and software, various illustrative blocks, modules, elements, components, methods and algorithms have been described generally in terms of their functionality. Whether such functionality is implemented as hardware or software will depend upon the particular application and any imposed design constraints. For at least this reason, it is to be recognized that one of ordinary skill in the art can implement the described functionality in a variety of ways for a particular application. Further, various components and blocks can be arranged in a different order or partitioned differently, for example, without departing from the scope of the embodiments expressly described.

Computer hardware used to implement the various illustrative blocks, modules, elements, components, methods, and algorithms described herein can include a processor configured to execute one or more sequences of instructions, programming stances, or code stored on a non-transitory, computer-readable medium. The processor can be, for example, a general purpose microprocessor, a microcontroller, a digital signal processor, an application specific integrated circuit, a field programmable gate array, a programmable logic device, a controller, a state machine, a gated logic, discrete hardware components, an artificial neural network, or any like suitable entity that can perform calculations or other manipulations of data. In some embodiments, computer hardware can further include elements such as, for example, a memory (e.g., random access memory (RAM), flash memory, read only memory (ROM), programmable read only memory (PROM), erasable read only memory (EPROM)), registers, hard disks, removable disks, CD-ROMS, DVDs, or any other like suitable storage device or medium.

Executable sequences described herein can be implemented with one or more sequences of code contained in a memory. In some embodiments, such code can be read into the memory from another machine-readable medium. Execution of the sequences of instructions contained in the memory can cause a processor to perform the process steps described herein. One or more processors in a multi-processing arrangement can also be employed to execute instruction sequences in the memory. In addition, hard-wired circuitry can be used in place of or in combination with software instructions to implement various embodiments described herein. Thus, the present embodiments are not limited to any specific combination of hardware and/or software.

As used herein, a "machine-readable medium" refers to any medium that directly or indirectly provides instructions to a processor for execution. A machine-readable medium can take on many forms including, for example, non-volatile media, volatile media, and transmission media. Non-volatile media can include, for example, optical and magnetic disks. Volatile media can include, for example, dynamic memory. Transmission media can include, for example, coaxial cables, wire, fiber optics, and wires that form a bus. Common forms of machine-readable media can include, for example, floppy disks, flexible disks, hard disks, magnetic tapes, other like magnetic media, CD-ROMs, DVDs, other like optical media, punch cards, paper tapes and like physical media with patterned holes, RAM, ROM, PROM, EPROM and flash EPROM.

In some embodiments, the data collected during a drilling operation can be archived and used in future operations. In addition, the data and information can be transmitted or otherwise communicated (wired or wirelessly) to a remote location by a communication system (e.g., satellite communication or wide area network communication) for further analysis. The communication system can also allow for monitoring and/or performing of the methods described herein (or portions thereof).

Figure 3:
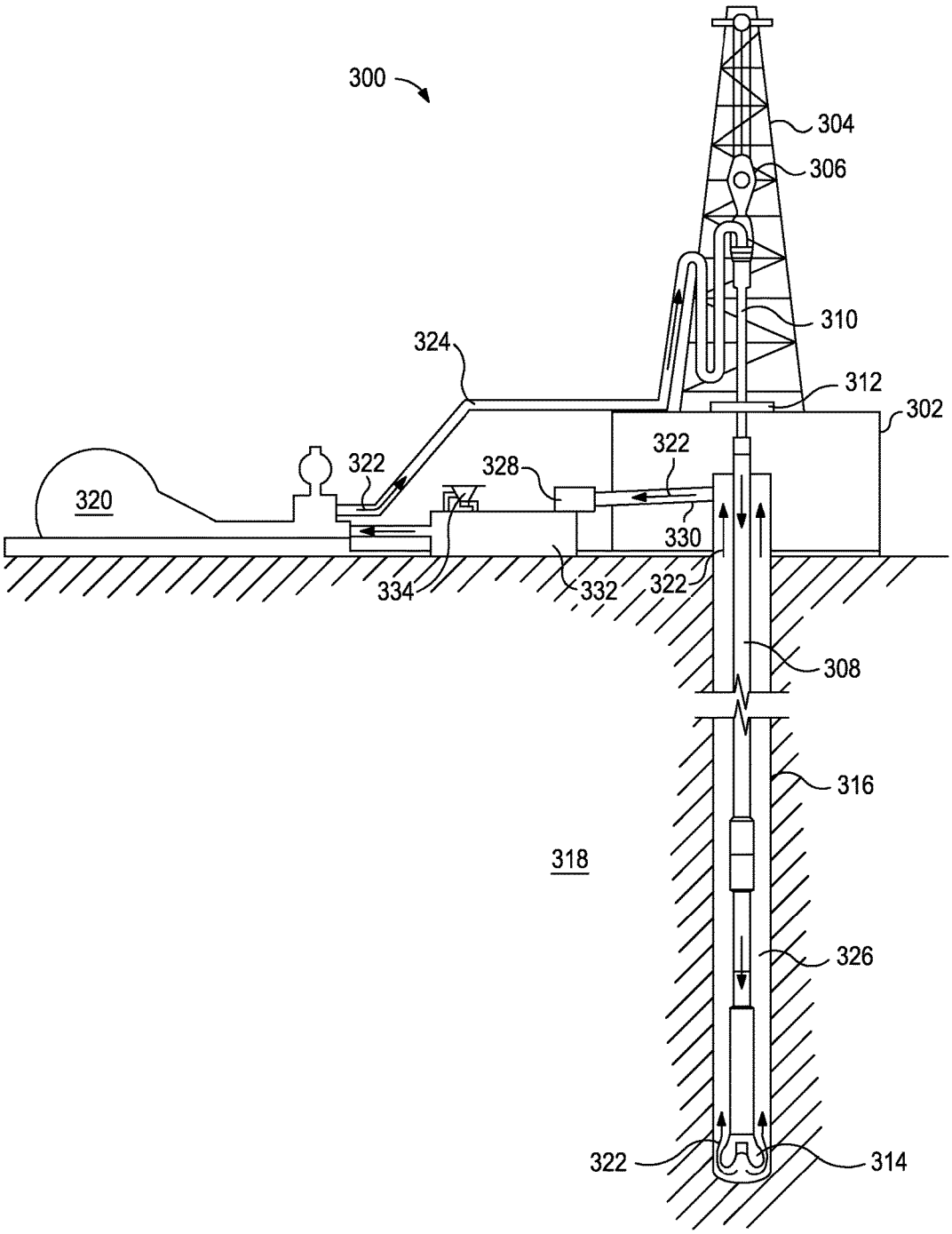
FIG. 3 illustrates a drilling assembly suitable for use in conjunction with at least one embodiment described herein.

As illustrated in FIG. 3, some embodiments may be a drilling assembly 300. It should be noted that while FIG. 3 generally depicts a land-based drilling assembly, those skilled in the art will readily recognize that the principles described herein are equally applicable to subsea drilling operations that employ floating or sea-based platforms and rigs, without departing from the scope of the disclosure.

The drilling assembly 300 may include a drilling platform 302 that supports a derrick 304 having a traveling block 306 for raising and lowering a drill string 308. The drill string 308 may include, but is not limited to, drill pipe and coiled tubing, as generally known to those skilled in the art. A kelly 310 supports the drill string 308 as it is lowered through a rotary table 312. A drill bit 314 is attached to the distal end of the drill string 308 and is driven either by a downhole motor and/or via rotation of the drill string 308 from the well surface. As the bit 314 rotates, it creates a borehole (or wellbore) 316 that penetrates various subterranean formations 318.

A pump 320 (e.g., a mud pump) circulates wellbore fluid 322 through a feed pipe 324 and to the kelly 310, which conveys the wellbore fluid 322 downhole through the interior of the drill string 308 and through one or more orifices in the drill bit 314. The wellbore fluid 322 is then circulated back to the surface via an annulus 326 defined between the drill string 308 and the walls of the borehole 316. At the surface, the recirculated or spent wellbore fluid 322 exits the annulus 326 and may be conveyed to one or more fluid processing unit(s) 328 via an interconnecting flow line 330. After passing through the fluid processing unit(s) 328, a "cleaned" wellbore fluid 322 is deposited into a nearby retention pit 332 (i.e., a mud pit). While illustrated as being arranged at the outlet of the borehole 316 via the annulus 326, those skilled in the art will readily appreciate that the fluid processing unit(s) 328 may be arranged at any other location in the drilling assembly 300 to facilitate its proper function, without departing from the scope of the scope of the disclosure.

The wellbore fluids 322 may be produced with a mixing hopper 334 communicably coupled to or otherwise in fluid communication with the retention pit 332. The mixing hopper 334 may include, but is not limited to, mixers and related mixing equipment known to those skilled in the art. In other embodiments, however, the wellbore fluid 322 may be produced at any other location in the drilling assembly 300. In at least one embodiment, for example, there could be more than one retention pit 332, such as multiple retention pits 332 in series. Moreover, the retention pit 332 may be representative of one or more fluid storage facilities and/or units where the disclosed individual wellbore fluid components may be stored, reconditioned, and/or regulated until added to the wellbore fluid 322.

One or more sensors, gauges, and the like for measuring the real-time data described herein (e.g., wellbore fluid properties, wellbore conditions relating to a section of the wellbore, operational parameters, and combinations thereof) may be coupled to at least one of the pump 320, the drill string 308, the rotary table 312, the drill bit 314, and the like. The data from these sensors, gauges, and the like may be transmitted (wired or wirelessly) to a computing station that implements the computational model and provides a sag profile of the section of the wellbore (or a transient wellbore condition determined therefrom), which may be used for performing a wellbore operation with at least one of a second operational parameter, a second wellbore fluid parameter, and a second wellbore condition based on the sag profile (or the transient wellbore condition determined therefrom).

Embodiments disclosed herein include:

A. a method that includes inputting at least one wellbore fluid property, at least one wellbore condition relating to a section of a wellbore, and at least one operational parameter into a computational method, wherein the computational method is configured to analyze sag within a section of a wellbore, and wherein the wellbore fluid property relates to a wellbore fluid that comprises a weighting agent; producing a sag profile of the section of the wellbore with the computational model; and performing a wellbore operation with at least one of a second operational parameter, a second wellbore fluid parameter, and a second wellbore condition based on the sag profile;

B. a method that includes measuring at least one wellbore fluid property, at least one wellbore condition relating to a section of a wellbore, and at least one operational parameter, and wherein the wellbore fluid property relates to a wellbore fluid that comprises a weighting agent; inputting the at least one wellbore fluid property, the at least one wellbore condition relating to a section of a wellbore, and the at least one operational parameter into a computational method; producing a sag profile of the section of the wellbore with the computational model; and performing a wellbore operation with at least one of a second operational parameter, a second wellbore fluid parameter, and a second wellbore condition based on the sag profile; and C. a method that includes measuring at least one wellbore fluid property, at least one wellbore condition relating to a section of a wellbore, and at least one operational parameter, and wherein the wellbore fluid property relates to a wellbore fluid that comprises a weighting agent; inputting the at least one wellbore fluid property, the at least one wellbore condition relating to a section of a wellbore, and the at least one operational parameter into a computational method; producing a sag profile of the section of the wellbore with the computational model; determining a transient wellbore condition in the section of the wellbore; and performing a wellbore operation on the section of the wellbore with a second operational parameter based on the transient wellbore condition.

Each of embodiments A, B, and C may have one or more of the following additional elements in any combination: Element 1: wherein the at least one wellbore fluid property comprises at least one selected from the group consisting of a solids settling rate, a sagged fluid composition, an associative stability between two weighting agent particles in the wellbore fluid, an associative stability between a weighting agent particle and an emulsified phase in the wellbore fluid, a concentration of weighting agent particles, a rheological property, a fluid density, an oil-to-water ratio, a gel property, a water-phase salinity, a static aging profile, a fluid compressibility, a temperature effect on a foregoing property, a pressure effect on a foregoing property, and any combination thereof; Element 2: wherein the at least one wellbore condition comprises at least one selected from the group consisting of a temperature in the wellbore, a pressure of the wellbore, a diameter of the wellbore, a length of the section of the wellbore, a deviation angle of the section of the wellbore, a drill string eccentricity, a wellbore depth, and any combination thereof; Element 3: wherein the at least one operational condition comprises at least one selected from the group consisting of a lapse time at a static condition or a low shear condition, a flow rate of the wellbore fluid, a drill string geometry, a drill string rotation speed, a tripping speed, a connection time, and any combination thereof; Element 4: wherein the sag profile identifies a sagged zone and a depleted zone; Element 5: wherein the sag profile identifies a volume percent for a sagged zone and a volume percent for a depleted zone based on a volume of the section of the wellbore; Element 6: wherein the wellbore operation is designed to mitigate a well control issue; Element 7: wherein the wellbore operation involves at least one of resuming a fluid flow for a time sufficient to reduce the volume percent of the depleted and sagged zones by a desired amount, modifying the wellbore fluid properties, modifying a flow rate, modifying a drill pipe rotation rate, and any combination thereof; Element 8: wherein producing the sag profile involves: meshing the section of the wellbore into a plurality of elements and performing a mass balance analysis on each of the elements for each component in the wellbore fluid; and Element 9: Element 8, wherein the mass balance analysis includes at least one input of the at least one wellbore fluid property, the at least one wellbore condition relating to the section of the wellbore, and the at least one operational parameter.

By way of non-limiting example, exemplary combinations applicable to A, B, C include: Element 1 in combination with Element 2; Element 1 in combination with Element 3; Element 2 in combination with Element 3; Element 1 in combination with Elements 2 and 3; Element 4 in combination with at least one of Elements 1-3; Element 5 in combination with at least one of Elements 1-3; Element 6 in combination with at least one of Elements 1-3; Element 7 in combination with at least one of Elements 1-3; Element 4 in combination with Element 6 and optionally also in combination with at least one of Elements 1-3; Element 4 in combination with Element 7 and optionally also in combination with at least one of Elements 1-3; Element 5 in combination with Element 6 and optionally also in combination with at least one of Elements 1-3; Element 5 in combination with Element 7 and optionally also in combination with at least one of Elements 1-3; and Element 6 in combination with Element 7 and optionally also in combination with at least one of Elements 1-3.

Other embodiments described herein may include a drilling assembly that includes a drilling platform that supports a derrick having a traveling block for raising and lowering a drill string; a drill bit attached to the distal end of the drill string; a pump fluidly connected to the drill string; at least one sensor or gauge coupled to at least one of the drill string, the pump, and the drill bit; and a computing device in communication with and capable of receiving data from the at least one sensor or gauge and configured to produce a sag profile (or a transient wellbore condition determined therefrom) from a computational method configured to analyze sage within a wellbore and including the data as at least one input.

One or more illustrative embodiments incorporating the invention embodiments disclosed herein are presented herein. Not all features of a physical implementation are described or shown in this application for the sake of clarity. It is understood that in the development of a physical embodiment incorporating the embodiments of the present invention, numerous implementation-specific decisions must be made to achieve the developer's goals, such as compliance with system-related, business-related, government-related and other constraints, which vary by implementation and from time to time. While a developer's efforts might be time-consuming, such efforts would be, nevertheless, a routine undertaking for those of ordinary skill the art and having benefit of this disclosure.

To facilitate a better understanding of the embodiments of the present invention, the following examples of preferred or representative embodiments are given. In no way should the following examples be read to limit, or to define, the scope of the invention.

EXAMPLES

A 2-D computational method was performed for a cross-section of a section of a wellbore with the inputs in Table 1. In the 2-D computational method, the wellbore section was meshed into elements of 1 foot by 1 inch size. The mass-balance analysis was performed as described above relative to Formulas 1-3 by taking into account the mass in and out of individual components in the fluid (e.g., aqueous phase, oil phase, and weighting agent particles).

Figure 2:
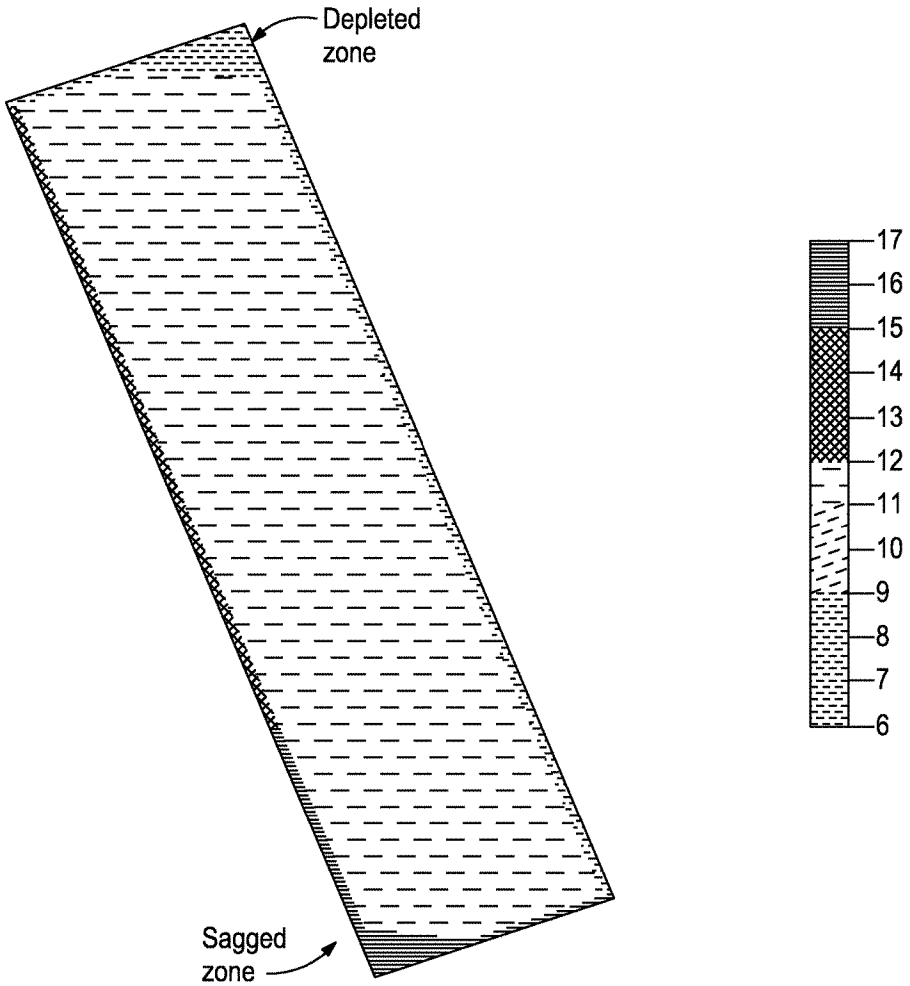
FIG. 2 is a sag profile from a computational method according to at least one embodiment described herein.

The output was sag profile illustrated in FIG. 2. The sag profile illustrates a high density zone predominantly at the bottom of the section but also extending along the adjacent wellbore wall adjacent to the high density zone. Similarly, the sag profile illustrates a low density zone predominantly at the top of the section but also extending along the adjacent wellbore wall adjacent to the high density zone.

TABLE 1

| Fluid Property Inputs* | |
|---|---|
| oil-to-water ratio | 80:20 |
| density | 12 ppg |
| weighting agent particle settling rate in the initially uniform fluid | 1 mm/hr |
| associative stability | 70% |
| **Wellbore Condition Inputs** | |
| section length | 500 ft |
| section width | 12 in |
| deviation from vertical | 20° |
| **Operational Parameter Inputs** | |
| static time | 25 hrs |

*Fluid property inputs were corrected for temperature and pressure.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

The invention claimed is:

1. A method comprising:

inputting at least one wellbore fluid property, at least one wellbore condition relating to a section of a wellbore, and at least one operational parameter into a computational method, wherein the computational method is configured to analyze sag within a section of a wellbore, and wherein the wellbore fluid property relates to a wellbore fluid that comprises a weighting agent;

producing a sag profile of the section of the wellbore with the computational model, wherein producing the sag profile involves: meshing the section of the wellbore into a plurality of elements and performing a mass balance analysis on each of the elements for each component in the wellbore fluid; and performing a wellbore operation with at least one of a second operational parameter, a second wellbore fluid parameter, and a second wellbore condition based on the sag profile.

2. The method of claim 1, wherein the at least one wellbore fluid property comprises at least one selected from the group consisting of a solids settling rate, a sagged fluid composition, an associative stability between two weighting agent particles in the wellbore fluid, an associative stability between a weighting agent particle and an emulsified phase in the wellbore fluid, a concentration of weighting agent particles, a rheological property, a fluid density, an oil-to-water ratio, a gel property, a water-phase salinity, a static aging profile, a fluid compressibility, a temperature effect on a foregoing property, a pressure effect on a foregoing property, and any combination thereof.

3. The method of claim 1, wherein the at least one wellbore condition comprises at least one selected from the group consisting of a temperature in the wellbore, a pressure of the wellbore, a diameter of the wellbore, a length of the section of the wellbore, a deviation angle of the section of the wellbore, a drill string eccentricity, a wellbore depth, and any combination thereof.

4. The method of claim 1, wherein the at least one operational condition comprises at least one selected from the group consisting of a lapse time at a static condition or a low shear condition, a flow rate of the wellbore fluid, a drill string geometry, a drill string rotation speed, a tripping speed, a connection time, and any combination thereof.

5. The method of claim 1, wherein the sag profile identifies a sagged zone and a depleted zone.

6. The method of claim 1, wherein the sag profile identifies a volume percent for a sagged zone and a volume percent for a depleted zone based on a volume of the section of the wellbore.

7. The method of claim 1, wherein the wellbore operation is designed to mitigate a well control issue.

8. The method of claim 1, wherein the wellbore operation involves at least one of resuming a fluid flow for a time sufficient to reduce the volume percent of the depleted and sagged zones by a desired amount, modifying the wellbore fluid properties, modifying a flow rate, modifying a drill pipe rotation rate, and any combination thereof.

9. A method comprising:

measuring at least one wellbore fluid property, at least one wellbore condition relating to a section of a wellbore, and at least one operational parameter, and wherein the wellbore fluid property relates to a wellbore fluid that comprises a weighting agent;

inputting the at least one wellbore fluid property, the at least one wellbore condition relating to a section of a wellbore, and the at least one operational parameter into a computational method;

meshing the section of the wellbore into a plurality of elements;

performing a mass balance analysis on each of the elements for each component in the wellbore fluid;

producing a sag profile of the section of the wellbore with the computational model based on the mass balance analysis on each of the elements; and performing a wellbore operation with at least one of a second operational parameter, a second wellbore fluid parameter, and a second wellbore condition based on the sag profile.

10. The method of claim 9, wherein the at least one wellbore fluid property comprises at least one selected from the group consisting of a solids settling rate, a sagged fluid composition, an associative stability between two weighting agent particles in the wellbore fluid, an associative stability between a weighting agent particle and an emulsified phase in the wellbore fluid, a concentration of weighting agent particles, a rheological property, a fluid density, an oil-to-water ratio, a gel property, a water-phase salinity, a static aging profile, a fluid compressibility, a temperature effect on a foregoing property, a pressure effect on a foregoing property, and any combination thereof.

11. The method of claim 9, wherein the at least one wellbore condition comprises at least one selected from the group consisting of a temperature in the wellbore, a pressure of the wellbore, a diameter of the wellbore, a length of the section of the wellbore, a deviation angle of the section of the wellbore, a drill string eccentricity, a wellbore depth, and any combination thereof.

12. The method of claim 9, wherein the at least one operational condition comprises at least one selected from the group consisting of a lapse time at a static condition or a low shear condition, a flow rate of the wellbore fluid, a drill string geometry, a drill string rotation speed, a tripping speed, a connection time, and any combination thereof.

13. The method of claim 9, wherein the sag profile identifies a volume percent for a sagged zone and a volume percent for a depleted zone based on a volume of the section of the wellbore.

14. A method comprising:

measuring at least one wellbore fluid property, at least one wellbore condition relating to a section of a wellbore, and at least one operational parameter, and wherein the wellbore fluid property relates to a wellbore fluid that comprises a weighting agent;

inputting the at least one wellbore fluid property, the at least one wellbore condition relating to a section of a wellbore, and the at least one operational parameter into a computational method;

producing a sag profile of the section of the wellbore with the computational model, wherein producing the sag profile involves: meshing the section of the wellbore into a plurality of elements and performing a mass balance analysis on each of the elements for each component in the wellbore fluid;

determining a transient wellbore condition in the section of the wellbore; and performing a wellbore operation on the section of the wellbore with a second operational parameter based on the transient wellbore condition.

15. The method of claim 14, wherein the at least one wellbore fluid property comprises at least one selected from the group consisting of a solids settling rate, a sagged fluid composition, an associative stability between two weighting agent particles in the wellbore fluid, an associative stability between a weighting agent particle and an emulsified phase in the wellbore fluid, a concentration of weighting agent particles, a rheological property, a fluid density, an oil-to-water ratio, a gel property, a water-phase salinity, a static aging profile, a fluid compressibility, a temperature effect on a foregoing property, a pressure effect on a foregoing property, and any combination thereof.

16. The method of claim 14, wherein the at least one wellbore condition comprises at least one selected from the group consisting of a temperature in the wellbore, a pressure of the wellbore, a diameter of the wellbore, a length of the section of the wellbore, a deviation angle of the section of the wellbore, a drill string eccentricity, a wellbore depth, and any combination thereof.

17. The method of claim 14, wherein the at least one operational condition comprises at least one selected from the group consisting of a lapse time at a static condition or a low shear condition, a flow rate of the wellbore fluid, a drill string geometry, a drill string rotation speed, a tripping speed, a connection time, and any combination thereof.

* * * * *